US008141865B2

(12) United States Patent
Utagawa et al.

(10) Patent No.: US 8,141,865 B2
(45) Date of Patent: Mar. 27, 2012

(54) SHEET FEEDING DEVICE AND IMAGE FORMING APPARATUS WITH DIFFERENT SEPARATING AND SUCTIONING OPERATIONAL TIMINGS

(75) Inventors: Hiroaki Utagawa, Miyagi (JP); Munehisa Fuda, Miyagi (JP)

(73) Assignee: Ricoh Company, Limited, Tokyo (JP)

( * ) Notice: Subject to any disclaimer, the term of this patent is extended or adjusted under 35 U.S.C. 154(b) by 0 days.

(21) Appl. No.: 12/929,456

(22) Filed: Jan. 26, 2011

(65) Prior Publication Data

US 2011/0187044 A1 Aug. 4, 2011

(30) Foreign Application Priority Data

Feb. 3, 2010 (JP) ..... 2010-022424

(51) Int. Cl.
*B65H 3/14* (2006.01)

(52) U.S. Cl. ..... 271/98; 271/31

(58) Field of Classification Search ..... 271/98, 271/108, 31

See application file for complete search history.

(56) References Cited

U.S. PATENT DOCUMENTS 5,090,676 A * 2/1992 Matsuno et al. ..... 271/98
7,007,944 B1 * 3/2006 Dobbertin et al. ..... 271/98
7,832,720 B2 * 11/2010 Fujita ..... 271/98
2005/0040584 A1 * 2/2005 Isemura ..... 271/98
2005/0206068 A1 * 9/2005 Sasaki et al. ..... 271/98

FOREIGN PATENT DOCUMENTS

| | | | |
|---|---|---|---|
| JP | 2934442 | A | 3/1990 |
| JP | 2000103535 | A | 4/2000 |
| JP | 2000177870 | A | 6/2000 |
| JP | 2001031273 | A | 2/2001 |
| JP | 3959629 | A | 3/2004 |
| JP | 2004224505 | A | 8/2004 |
| JP | 2006016159 | A | 1/2006 |
| JP | 4495637 | A | 12/2006 |
| JP | 4516504 | B2 | 2/2007 |
| JP | 2007331905 | A | 12/2007 |
| JP | 2008308303 | A | 12/2008 |
| JP | 2009190840 | A | 8/2009 |
| JP | 2009203072 | A | 9/2009 |
| JP | 2010089955 | A | 4/2010 |

* cited by examiner

*Primary Examiner* — Gerald McClain
(74) *Attorney, Agent, or Firm* — Harness, Dickey & Pierce, P.L.C.

(57) ABSTRACT

A sheet feeding device includes an air separating unit includes a floating air blowing unit and a separating air blowing unit that blow air to leading edges of a bundle of sheets in a paper feeding direction to float and separate upper sheets, and a side air blowing unit that blows air to both side edges of the sheet bundle to separate each of the sheets in the bundle, an air suctioning unit that suctions the air to suction a top sheet thus separated, a sheet feeding unit that feeds the sheet thus suctioned and retained, and a control unit that controls to blow floating air, to blow separating air, to blow side air, and to suction the air all at different operational timings.

13 Claims, 15 Drawing Sheets

SHEET FEEDING DEVICE AND IMAGE FORMING APPARATUS WITH DIFFERENT SEPARATING AND SUCTIONING OPERATIONAL TIMINGS

CROSS-REFERENCE TO RELATED APPLICATIONS

The present application claims priority to and incorporates by reference the entire contents of Japanese Patent Application No. 2010-022424 filed in Japan on Feb. 3, 2010.

BACKGROUND OF THE INVENTION

1. Field of the Invention

The present invention relates to a sheet feeding device and an image forming apparatus, and more particularly to a pneumatic suction sheet feeding device that separates a sheet located at the top of a stacked bundle of sheets to feed one sheet at a time, and an image forming apparatus such as an electrophotographic copying machine, a facsimile, or a printer including such a sheet feeding device.

2. Description of the Related Art

As widely known, types of sheet feeding devices for taking out and feeding one sheet at a time from a stacked bundle of sheets generally include frictional sheet feeding devices and pneumatic sheet feeding devices. Japanese Patent Application Laid-open No. 2001-31273, for example, discloses an example of a pneumatic sheet feeding device that separates sheets in a bundle by blowing or discharging air thereto, and feeds the sheet downstream in a conveying direction using a sheet feeding unit consisting of various rollers located at a portion of a sheet supply tray near a leading-edge in a feeding direction.

In addition, suggestions have recently been made for a pneumatic suction sheet feeding device including a plurality of air blowing units blowing or discharging air to separate sheets in a bundle more reliably by causing the air blowing units to blow the air to the sheets, and feeding a top sheet thus separated while suctioning the sheet with an air suctioning unit.

As this type of pneumatic suction sheet feeding devices, a sheet feeding device illustrated in FIG. 11 is known.

As illustrated in FIG. 11, a conventional sheet feeding device 200 includes an air blowing unit 202 that blows air to a bundle of sheets stacked on a paper feed tray 201 to float and to separate upper sheets including at least the top sheet in the bundle, an air suctioning unit 203 that suctions the top sheet thus separated, and a sheet feeding unit 204 having a suctioning belt for feeding the sheet thus suctioned and retained by the air suctioning unit 203 in a sheet feeding direction. The air blowing unit 202 includes a blower fan for generating the air to be blown to the sheet bundle, and the air suctioning unit 203 includes a blower fan for generating air for suctioning the top sheet.

The air blowing units 202 are arranged each at the leading-edge of the sheet bundle in the feeding direction and at both side edges of the sheet bundle. These air blowing units 202 are configured to blow the air to the leading-edge of the sheet bundle in the sheet feeding direction and to the side edges of the sheet bundle. The air blowing unit 202 arranged at the leading-edge side of the sheet bundle in the sheet feeding direction includes an air blowing unit for blowing floating air for floating upper sheets including at least the top sheet in the sheet bundle, and an air blowing unit for blowing separating air for separating the sheets.

The paper feed tray 201 can be moved up and down by a lifting unit not illustrated. A sheet position detecting unit 205 is configured to detect the position of the top sheet in the sheet bundle stacked on the paper feed tray 201.

The sheet position detecting unit 205 has an actuator 205*a* that has a roller located at the tip thereof and abutting on the top sheet and that can be swung depending on the height of the sheet bundle, and a detecting sensor 205*b* such as a photointerrupter that detects an amount of the swing of the actuator 205*a*.

The position to which the paper feed tray 201 is moved up and down is adjusted so that a distance h between the top sheet and the sheet feeding unit 204 is kept constant based on a detection signal of the detecting sensor 205*b*.

A sheet blocking member 206 for preventing sheets other than the top sheet from being fed is arranged at a side of the paper feed tray 201 near the leading-edge in the feeding direction.

An operation of the conventional sheet feeding device will now be explained with reference to the flowchart illustrated in FIG. 13, and also with reference to FIGS. 12A to 12D as required.

As illustrated in FIG. 13, when a paper feed command is received from an image forming apparatus body (Step S201), the lifting unit not illustrated lifts the paper feed tray 201 (Step S202). When the sheet position detecting unit 205 detects the top sheet reaching a specified position (YES at Step S203), the lifting unit stops lifting the paper feed tray 201 (Step S204).

The air blowing units 202 then start blowing the floating air, the separating air, and side air, and the air suctioning unit 203 starts suctioning the air at the same time (Steps S205 to S208). In other words, the operations at Steps S205 to S208 are all started simultaneously.

When specified seconds elapse from the time when the processes at Steps S205 to S208 are started (YES at Step S209), a paper feeding operation is started (Step S210).

In the paper feeding operation, as illustrated in FIG. 12A, a driving unit not illustrated drives the sheet feeding unit 204, so that a top sheet P1 that is separated, suctioned to, and retained by the sheet feeding unit 204 in the operations at Steps S205 to S208 is fed towards carriage rollers 207.

The carriage rollers 207 then convey the top sheet P1 further upstream as illustrated in FIG. 12B. As illustrated in FIG. 12C, when a paper feeding sensor 208 detects the leading edge of the top sheet P1, driving the sheet feeding unit 204 is stopped. At this time, the carriage rollers 207 continue to convey the top sheet P1 while the sheet feeding unit 204 is no longer driven.

When the top sheet P1 passes through the suctioning section, a sheet P2 that is a next original is floated, separated, suctioned, and retained as the top sheet in the operations at Steps S205 to S208 as illustrated in FIG. 12D. The driving unit starts driving the sheet feeding unit 204 again based on a preset paper feeding interval to feed the sheet P2.

By repeating these operations, the sheets stacked on the paper feed tray 201 are fed sequentially.

When the abovementioned paper feeding operation is completed (Step S211), the air blowing units 202 stop blowing the floating air, the separating air, and the side air, and the air suctioning unit 203 stops suctioning the air simultaneously as illustrated in FIG. 13 (Steps S212 to S215). In other words, the stopping operations at Steps S212 to S215 are all performed simultaneously.

A series of paper feeding jobs is then ended (Step S216).

A large amount of power is consumed immediately after each of the blower fans in the air blowing units 202 and the air suctioning unit 203 is started, as illustrated in FIG. 14B.

In the conventional sheet feeding device, the air blowing units 202 start blowing the floating air, the separating air, and the side air, and the air suctioning unit 203 starts suctioning the air all at the same time (see Steps S205 to S208 in FIG. 13). Therefore, the moments of surging power consumption coincide immediately after the blower fans in the air blowing units 202 and the air suctioning unit 203 are started, and an enormous amount of power is consumed as a whole as indicated as a rise in a waveform S illustrated in FIG. 14A.

Furthermore, as illustrated in FIG. 15, in the conventional sheet feeding device, because the air is blown simultaneously to the leading edge of the sheet bundle in the paper feeding direction and to the side edges of the sheet bundle, the position of the sheets is not stabilized when they are floated. Therefore, the sheets are fed without having their position stabilized, resulting in a skew or a registration error.

Moreover, in the conventional sheet feeding device, the air blowing units 202 stop blowing the floating air, the separating air, and the side air, and the air suctioning unit 203 stops suctioning the air all at the same time (see Steps S212 to S215 in FIG. 13) when a series of paper feeding jobs is completed. However, the inertia keeps the blower fans of the air blowing units 202 and the air suctioning unit 203 running.

Therefore, even if the paper feeding jobs are completed, sheets are kept suctioned to and retained by the sheet feeding unit 204.

Thus, if the user considers that the paper feeding operation has been completed in this condition and opens the paper feed tray 201, the sheets kept suctioned to and retained by the sheet feeding unit 204 due to the inertia of the blower fans might not return to a predetermined position in the paper feed tray 201, and might fall into a position in the sheet feeding device body where the user would have a difficult time removing them, or the sheets might be damaged due to such causes.

SUMMARY OF THE INVENTION

It is an object of the present invention to at least partially solve the problems in the conventional technology.

According to an aspect of the present invention, there is provided a sheet feeding device including: an air separating unit that blows air to a stacked bundle of sheets to separate each of sheets in the bundle; an air suctioning unit that suctions air to suction a top sheet thus separated; and a sheet feeding unit that feeds the sheet, which is suctioned to and retained by the air suctioning unit in a separating and suctioning operation performed by the air separating unit and the air suctioning unit, in a sheet feeding direction. The air separating unit includes: a floating air blowing unit that blows air to leading edges of the bundle of sheets in the sheet feeding direction to float upper sheets including at least the top sheet in the bundle; a separating air blowing unit that blows air to the leading edges of the bundle of sheets in the sheet feeding direction, which are floated by the floating air blowing unit, to separate each sheet in the bundle; and a side air blowing unit that blows air to both side edges of the bundle of sheets to separate each of the sheets in the bundle, which are floated, from both side edges of the bundle of sheets. The sheet feeding device further includes a control unit that controls to cause the floating air blowing unit to blow the air, to cause the separating air blowing unit to blow the air, to cause the side air blowing unit to blow the air, and to cause the air suctioning unit to suction the air all at different operational timings in the separating and suctioning operation.

According to another aspect of the present invention, there is provided an image forming apparatus including: the sheet feeding device and an image forming unit that forms an image on a sheet separated and fed by the sheet feeding device.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

An exemplary embodiment according to the present invention is described below with reference to some drawings.

Figure 1:
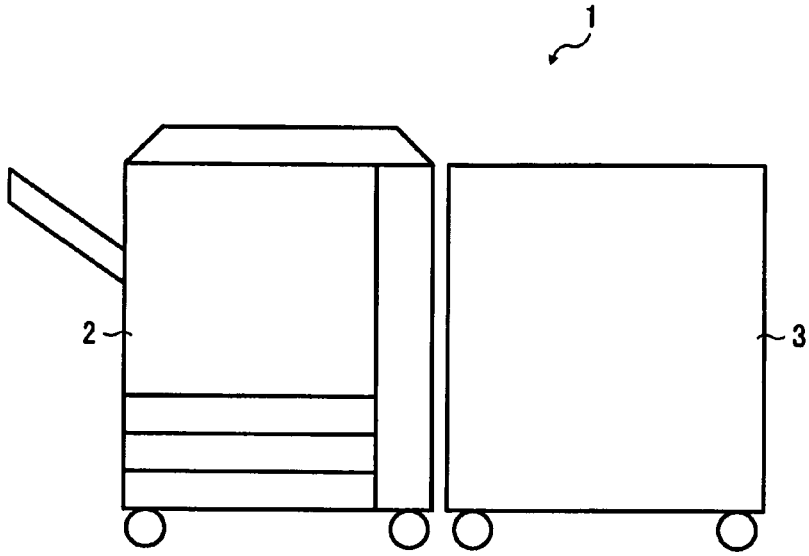
FIG. 1 is a schematic of an image forming apparatus including a sheet feeding device according to an embodiment of the present invention.

FIG. 1 shows an image forming apparatus including a sheet feeding device according to an embodiment of the present invention.

As illustrated in FIG. 1, an image forming apparatus 1 includes an image forming unit 2 as an image forming unit and a paper feeding unit 3.

The image forming unit 2 forms an image on a supplied sheet using a known electrophotographic process, ink-jet process, or the like. Because detailed structures of the image forming unit 2 do not make up the essential part of the present invention, explanations thereof are omitted herein.

A sheet feeding device 10 (see FIG. 4) is located inside the paper feeding unit 3, and is used to feed a sheet to the image forming unit 2 via a conveying path not illustrated.

Figure 2:
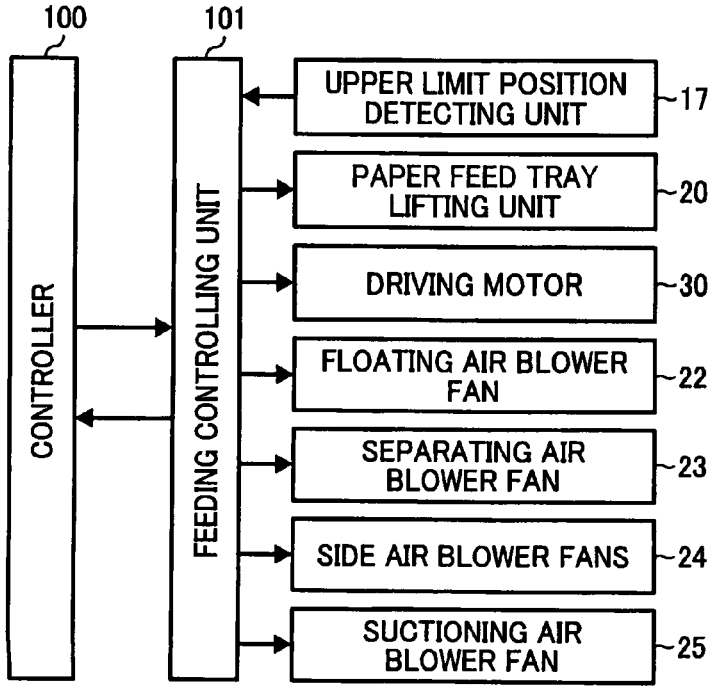
FIG. 2 is a block diagram of a controller and a feeding controlling section included in the image forming apparatus according to the embodiment of the present invention.

As illustrated in FIG. 2, the image forming apparatus 1 also includes a controller 100 and a feeding controlling section 101.

The controller 100 controls an image forming operation performed by the image forming unit 2, and outputs a feed signal to the feeding controlling section 101 based on an input signal received via an operation input unit not illustrated or an input signal received from a host computer, etc. externally connected.

The feeding controlling section 101 controls various operations such as a separating and suctioning operation and a paper feeding operation performed in the sheet feeding device 10 based on a feed signal received from the controller 100.

The sheet feeding device 10 will now be explained with reference to FIGS. 3 to 10.

Figure 3:
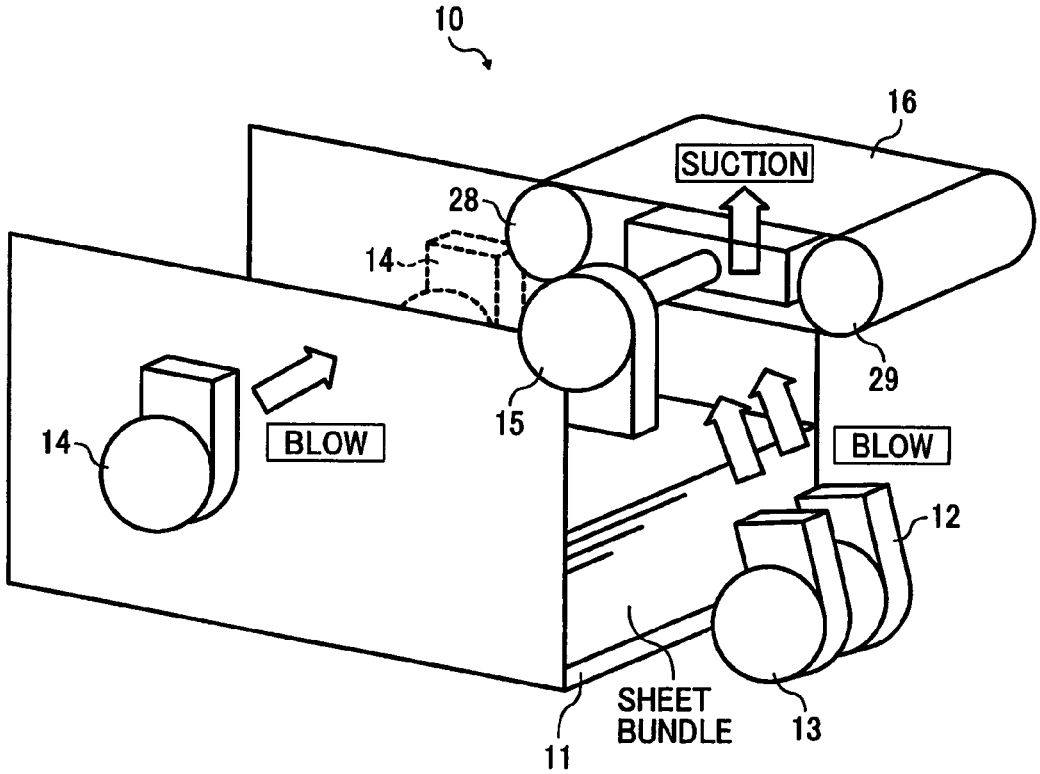
FIG. 3 is a perspective view for explaining a structure of the sheet feeding device according to the embodiment.
Figure 4:
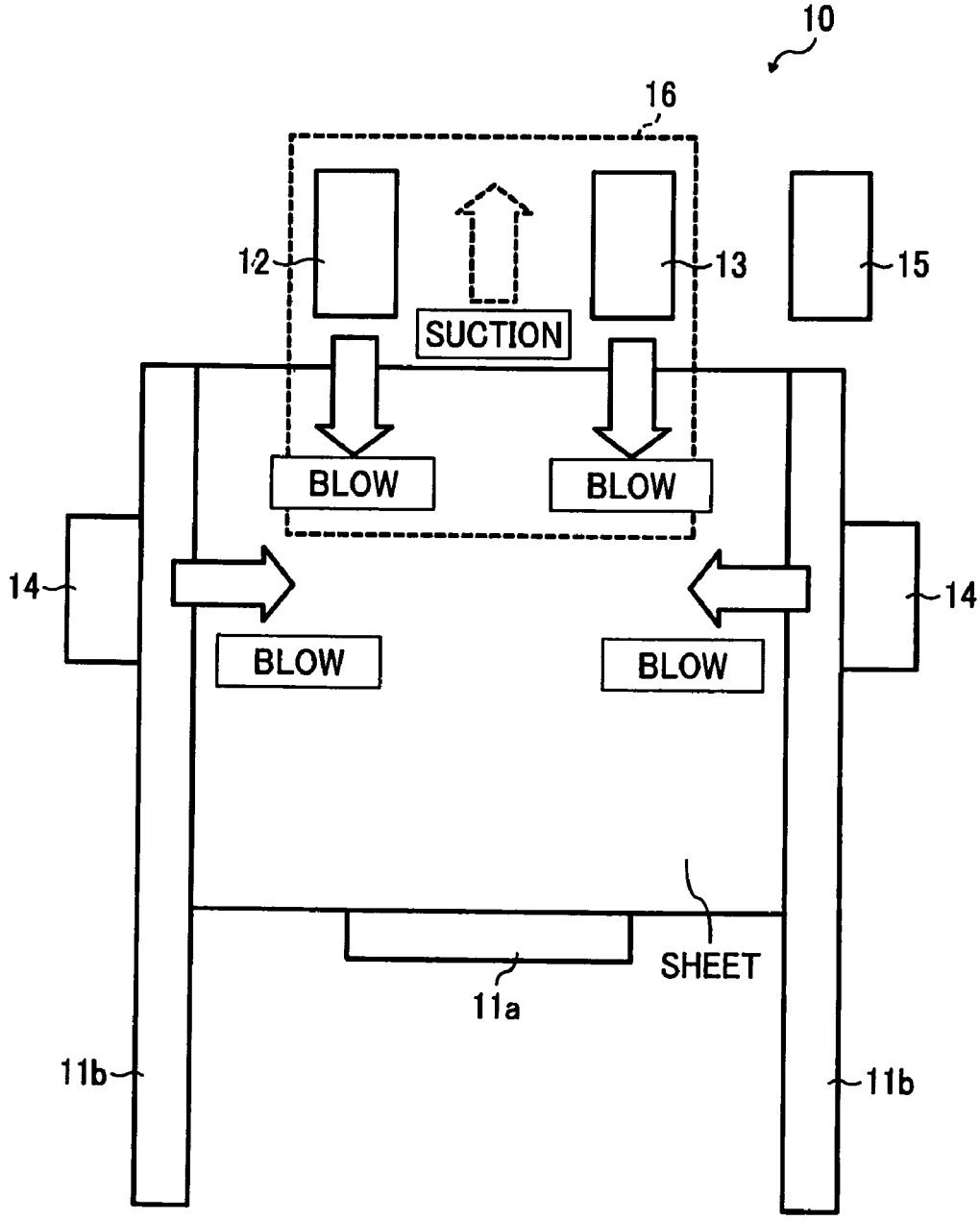
FIG. 4 is a schematic for explaining the structure of the sheet feeding device according to the embodiment.

As illustrated in FIGS. 3 and 4, the sheet feeding device 10 includes a paper feed tray 11, a floating air blowing device 12 as a floating air blowing unit, a separating air blowing device 13 as a separating air blowing unit, side air blowing devices 14 as side air blowing units, an air suctioning device 15 as an air suctioning unit, a suctioning belt 16 as a sheet feeding unit, and an upper limit position detecting unit 17.

The paper feed tray 11 is placed at a lower portion of the sheet feeding device 10, and a bundle of sheets is stacked on the paper feed tray 11. The paper feed tray 11 can be moved up and down in a vertical direction by a paper feed tray lifting unit 20 not illustrated. The paper feed tray lifting unit 20 is connected to the feeding controlling section 101 as illustrated in FIG. 2, and moves the paper feed tray 11 up and down based on an input signal from the feeding controlling section 101. More specifically, the feeding controlling section 101 controls the paper feed tray lifting unit 20 based on a detection signal received from the upper limit position detecting unit 17 connected to the feeding controlling section 101 to move the paper feed tray 11 to a specified position. The paper feed tray lifting unit 20 includes a driving unit such as a lifting motor.

The paper feed tray 11 has an end fence 11*a* arranged at a trailing-edge opposite to the leading-edge in the sheet feeding direction, and abutting on the trailing edges of the sheets to align them, and a pair of side fences 11*b* arranged at both side edges in a direction perpendicular to the sheet feeding direction to support the sheet being fed.

The floating air blowing device 12 is arranged in a manner facing the leading edge of the sheet bundle in the sheet feeding direction, and includes a floating air blower fan 22 (see FIG. 2) as a driving source for blowing floating air. The floating air blowing device 12 blows the air generated by driving the floating air blower fan 22 to the leading edge of the sheet bundle in the sheet feeding direction to float the upper sheets including at least the top sheet in the sheet bundle.

As with the floating air blowing device 12, the separating air blowing device 13 is arranged in a manner facing the leading edge of the sheet bundle in the sheet feeding direction, and includes a separating air blower fan 23 (see FIG. 2) as a driving source for blowing separating air. The separating air blowing device 13 blows the air generated by driving the separating air blower fan 23 to the leading edge, in the sheet feeding direction, of the sheets, which are floated by the floating air blowing device 12, to separate each of the floated sheets.

The side air blowing devices 14 are arranged in pair in a manner facing each side edge of the sheet bundle in a direction perpendicular to the sheet feeding direction, and include a side air blower fan 24 (see FIG. 2) as a driving source for blowing side air. The side air blowing devices 14 blow the air generated by driving the side air blower fans 24 to both side edges of the sheet bundle to separate each of the floated sheets from both side edges of the sheet bundle.

In the embodiment, the floating air blowing device 12, the separating air blowing device 13, and the side air blowing devices 14 function as air separating unit according to the present invention.

The air suctioning device 15 is disposed above the floating air blowing device 12 and the separating air blowing device 13, and includes a suctioning air blower fan 25 (see FIG. 2) as a driving source for suctioning air.

Figure 5:
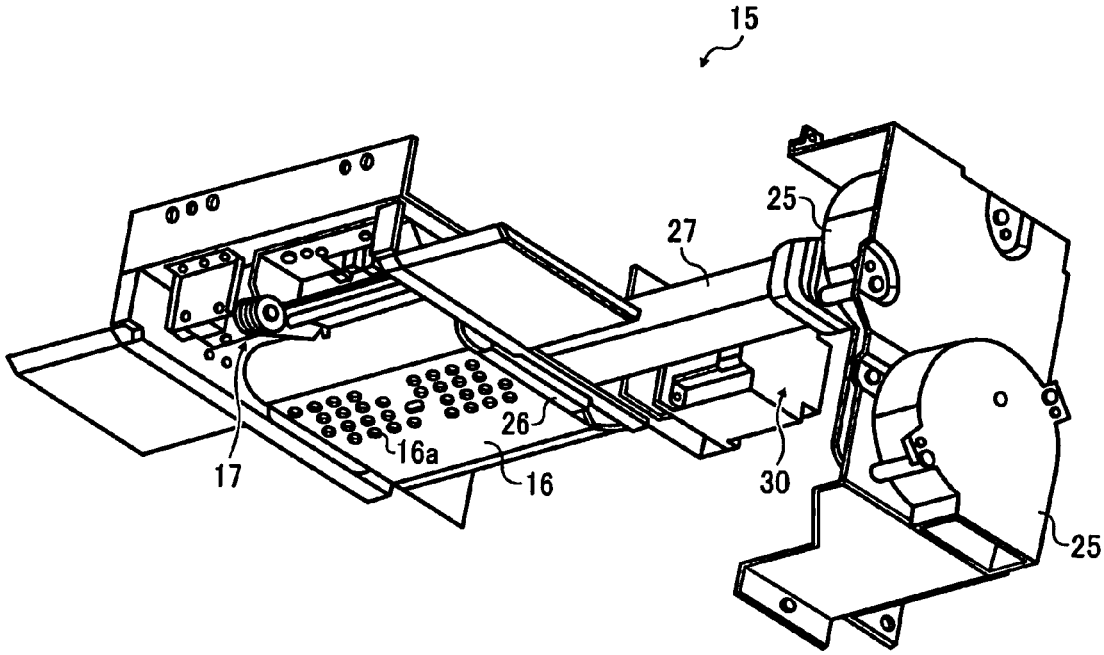
FIG. 5 is a perspective view of a part of the sheet feeding device according to the embodiment.

As illustrated in FIG. 5, the air suctioning device 15 includes a suctioning chamber 26 housed in a space surrounded by the suctioning belt 16 located above and below the space, and a suctioning duct 27 connecting the suctioning air blower fan 25 to the suctioning chamber 26.

As illustrated in FIG. 3, the suctioning belt 16 is stretched across a driven roller 28 and a driving roller 29, and is moved endlessly by the rotation of the driving roller 29. As illustrated in FIG. 5, the driving roller 29 is linked to a driving motor 30, and is driven to rotate by the driving motor 30.

The suctioning belt 16 also has a plurality of holes 16*a* for allowing the air to be suctioned.

By driving the suctioning air blower fan 25, the air suctioning device 15 suctions the air, and thus brings the pressure in the suctioning chamber 26 to a negative pressure.

In this manner, the top sheet separated from the sheet bundle is suctioned to and retained by the suctioning belt 16 through the holes 16*a*. The driving motor 30 is driven at a predetermined operational timing set depending on each of the sheets, based on a driving signal received from the feeding controlling section 101, and thus drives the suctioning belt 16 endlessly with the top sheet suctioned thereto and retained thereby. In this manner, the top sheet thus suctioned and retained by the suctioning belt 16 is fed in the sheet feeding direction.

The upper limit position detecting unit 17 includes a lever held in a manner abutting on the top surface of the sheet so as to be swung depending on the height of the sheet bundle, and a detecting sensor such as a transmissive photointerrupter. When the paper feed tray 11 reaches the specified position, the lever is swung so that the transmissive photointerrupter moves from a blocked state to a light-receiving state. In this manner, the upper limit position detecting unit 17 detects that the sheet has reached an upper limit detecting position.

The sheet feeding device 10 also includes the feeding controlling section 101. As illustrated in FIG. 2, the upper limit position detecting unit 17, the paper feed tray lifting unit 20, the driving motor 30, the floating air blower fan 22, the separating air blower fan 23, the side air blower fans 24, and the suctioning air blower fan 25 are connected to the feeding controlling section 101. The feeding controlling section 101 according to the embodiment functions as a control unit according to the present invention.

The feeding controlling section 101 stops driving the paper feed tray lifting unit 20 based on a detection signal received from the upper limit position detecting unit 17, and controls to drive the floating air blower fan 22, the separating air blower fan 23, the side air blower fans 24, the suctioning air blower fan 25 all at different operational timings.

In this manner, the floating air blowing device 12 is caused to blow the air, the separating air blowing device 13 is caused to blow the air, the side air blowing devices 14 are caused to blow the air, and the air suctioning device 15 is caused to suction the air all at different timings.

A separating and suctioning operation performed in the sheet feeding device 10 will now be explained with reference to FIGS. 6 to 10.

The separating and suctioning operation is an operation performed in the sheet feeding device 10 before starting the paper feeding operation, and includes separating the top sheet from the sheet bundle stacked on the paper feed tray 11 and causing the suctioning belt 16 to suction and to retain the top sheet.

Figure 6:
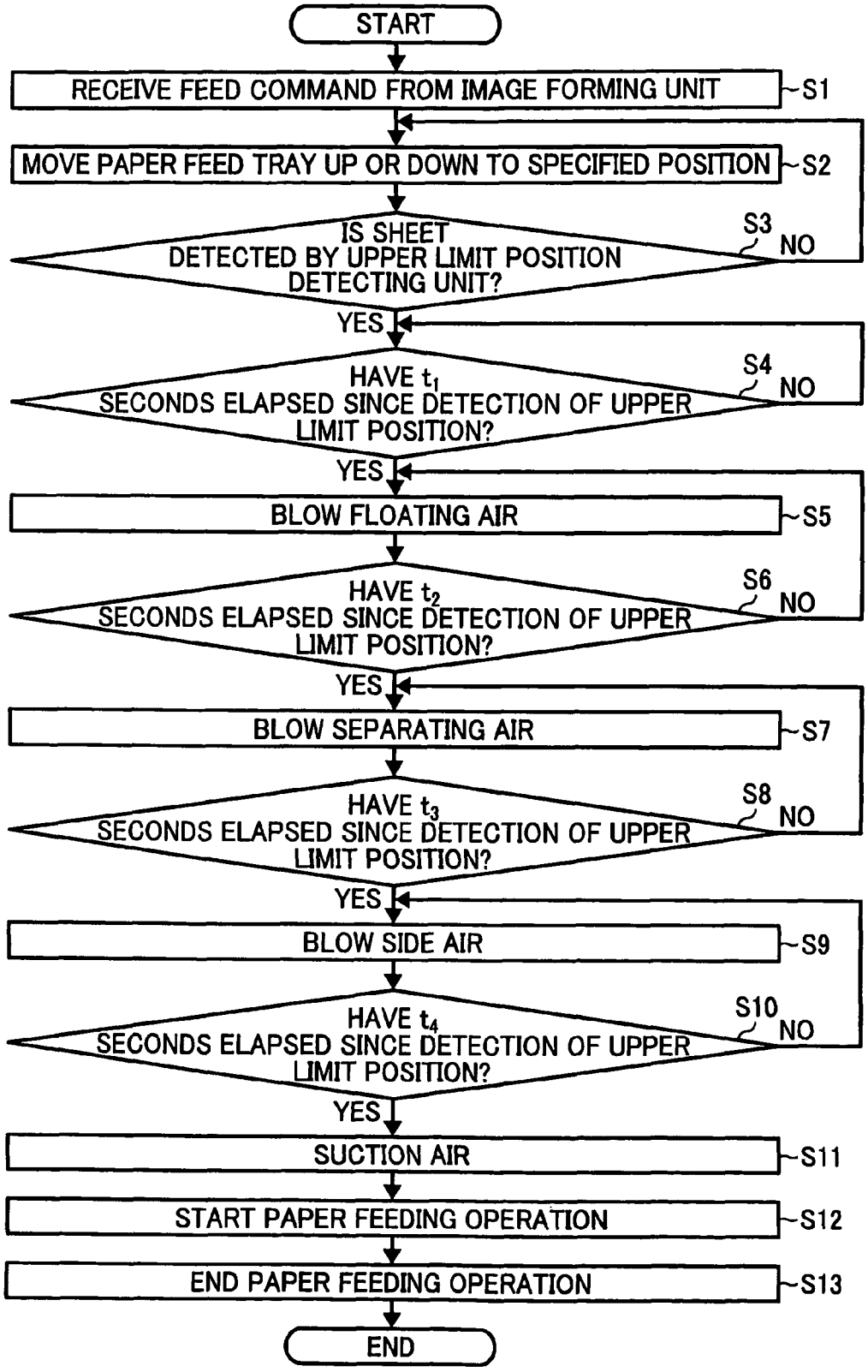
FIG. 6 is a flowchart of a separating and suctioning operation performed in the sheet feeding device according to the embodiment.

As illustrated in FIG. 6, when the feeding controlling section 101 receives a feed command from the image forming unit 2, that is, a feed signal from the controller 100 (Step S1), the feeding controlling section 101 outputs a driving signal to the paper feed tray lifting unit 20 to cause the paper feed tray lifting unit 20 to move the paper feed tray 11 up or down to a specified position (Step S2).

The feeding controlling section 101 then repeats the process at Step S2 until the sheet reaches the upper limit detecting position and is detected by the upper limit position detecting unit 17 (NO at Step S3).

Once the upper limit position detecting unit 17 detects the sheet reaching the upper limit detecting position as the paper feed tray 11 is lifted, the feeding controlling section 101 goes on to a process at Step S4 (YES at Step S3).

The feeding controlling section 101 then determines if $t_1$ seconds have elapsed since the upper limit position detecting unit 17 detected the sheet reaching the upper limit detecting position (Step S4).

If the feeding controlling section 101 determines that $t_1$ seconds have elapsed, the feeding controlling section 101 controls to start driving the floating air blower fan 22, and the floating air blowing device 12 blows the floating air to the leading edge of the sheet bundle in the sheet feeding direction (Step S5). In this manner, the upper sheets including at least the top sheet in the sheet bundle are floated.

The feeding controlling section 101 then determines if $t_2$ seconds have elapsed since the upper limit position detecting unit 17 detected the sheet being at the upper limit detecting position (Step S6).

If the feeding controlling section 101 determines that $t_2$ seconds have elapsed, the feeding controlling section 101 controls to start driving the separating air blower fan 23, and the separating air blowing device 13 blows the separating air to the leading edge, in the sheet feeding direction, of the sheets floated by the floating air blowing device 12 (Step S7). In this manner, each of the floated sheets is loosened and separated.

Because the sheets are subjected to the floating air blown by the floating air blowing device 12 and the separating air blown by the separating air blowing device 13, the sheets are pushed towards the end fence 11*a* (see FIG. 4), and the trailing edges of the sheets abut on the end fence 11*a* to become aligned. In this manner, the registration error can be reduced.

The feeding controlling section 101 then determines if $t_3$ seconds have elapsed since the upper limit position detecting unit 17 detected the sheet being at the upper limit detecting position (Step S8).

If the feeding controlling section 101 determines that $t_3$ seconds have elapsed, the feeding controlling section 101 controls to start driving a pair of side air blower fans 24, and the side air blowing devices 14 blow the side air to both side edges of the sheet bundle (Step S9). In this manner, both side edges of the upper sheets including the top sheet are floated, and the entire sheets are floated. Therefore, the sheet is prevented from being suctioned in a manner tilted when the sheet is suctioned to the suctioning belt 16 by the suctioning air.

The feeding controlling section 101 then determines if $t_4$ seconds have elapsed since the upper limit position detecting unit 17 detected the sheet being at the upper limit detecting position (Step S10).

If the feeding controlling section 101 determines that $t_4$ seconds have elapsed, the feeding controlling section 101 controls to start driving the suctioning air blower fan 25, and the air suctioning device 15 suctions the air to bring the pressure in the suctioning chamber 26 to a negative pressure (Step S11). In this manner, the top sheet separated from the sheet bundle is suctioned to the suctioning belt 16 through the holes 16*a* and retained thereby.

Figure 13:
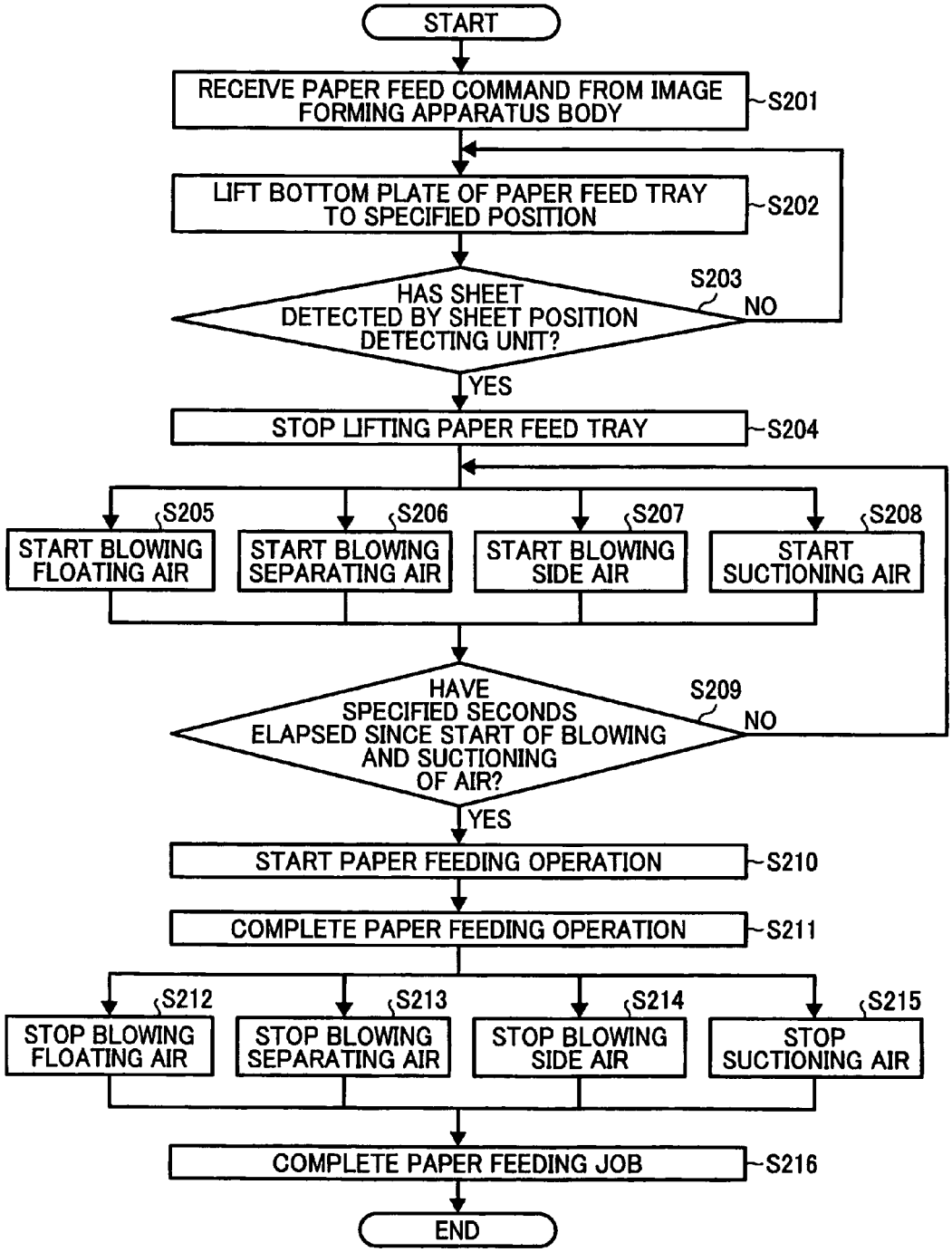
FIG. 13 CONVENTIONAL ART
FIG. 13 is flowchart of an operation of the conventional sheet feeding device.
Figure 14A:
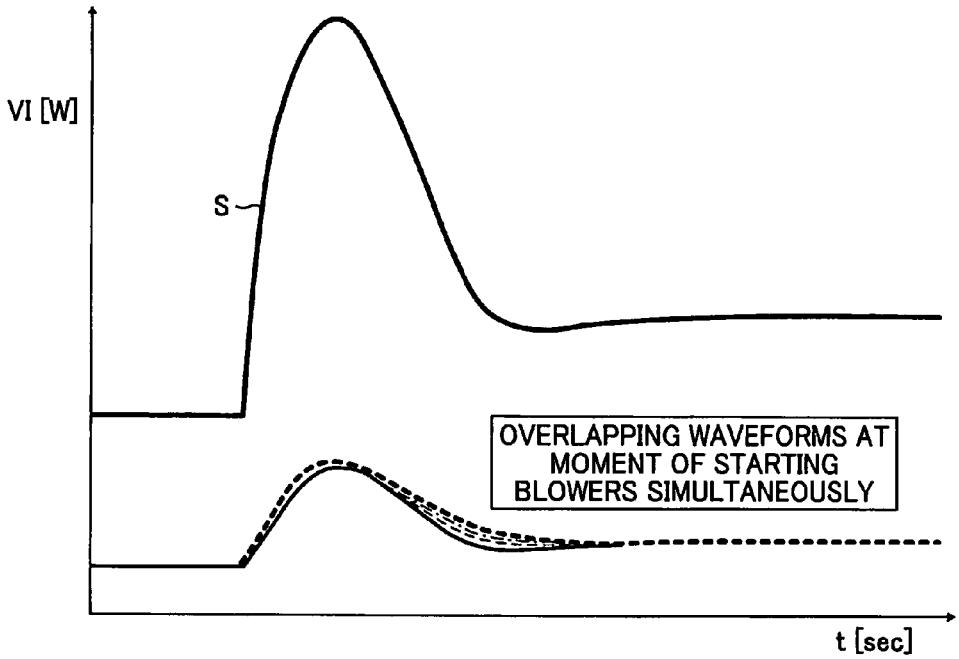
FIG. 14A CONVENTIONAL ART
FIG. 14A shows power consumption overlapping when the blower fans are started all at the same time in the conventional sheet feeding device.
Figure 14B:
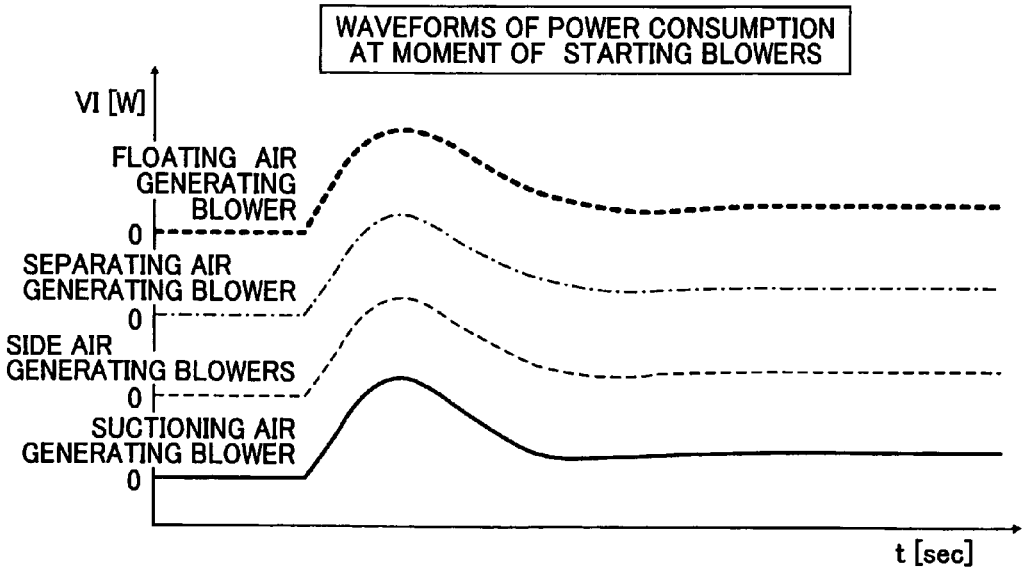
FIG. 14B CONVENTIONAL ART
FIG. 14B shows the individual power consumption corresponding to each of the blower fans in the conventional sheet feeding device.
Figure 15:
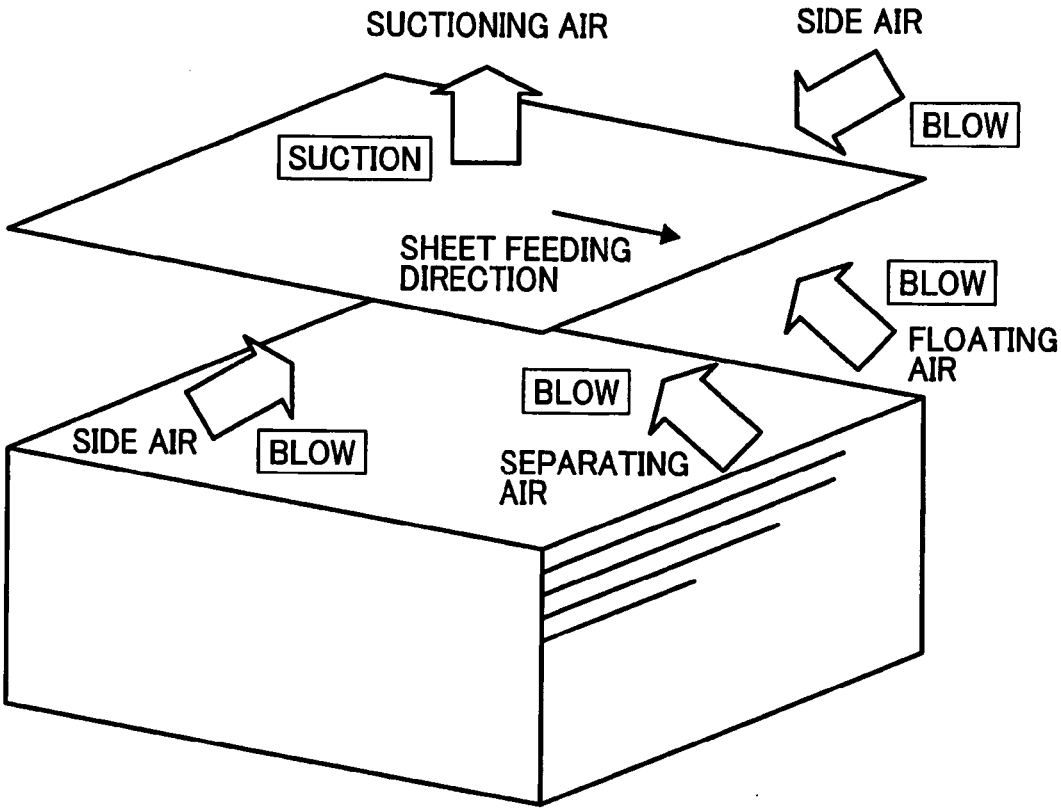
FIG. 15 CONVENTIONAL ART
FIG. 15 shows a floating sheet in the conventional sheet feeding device.

The feeding controlling section 101 then outputs a driving signal to the driving motor 30 to drive the suctioning belt 16 suctioning and retaining the top sheet. In other words, the paper feeding operation is started (Step S12). Because the paper feeding operation performed subsequently to the abovementioned separating and suctioning operation is the same as the conventional paper feeding operation (see Step S210 in FIG. 13), an explanation thereof is omitted herein.

The paper feeding operation is then completed (Step S13), and a series of processes is ended.

In the embodiment, an explanation of a process performed subsequently to the paper feeding operation is omitted. However, the paper feeding job is ended in the same manner as in a conventional example. At this time, that is, when the paper feeding job is completed, each of the blower fans is stopped being driven. However, the embodiment differs from conventional examples in that the blower fans are stopped being driven all at different operational timings. Such operational timings at which the blower fans are stopped being driven will be described later.

Furthermore, in the embodiment, each of the blower fans is started to be driven in the order of the floating air blower fan 22, the separating air blower fan 23, the side air blower fans 24, and the suctioning air blower fan 25. However, the order in which the blower fans are started to be driven is not limited thereto, and the order in which the blower fans are started to be driven may be changed as appropriate as long as the blower fans are driven at different operational timings.

Figure 7:
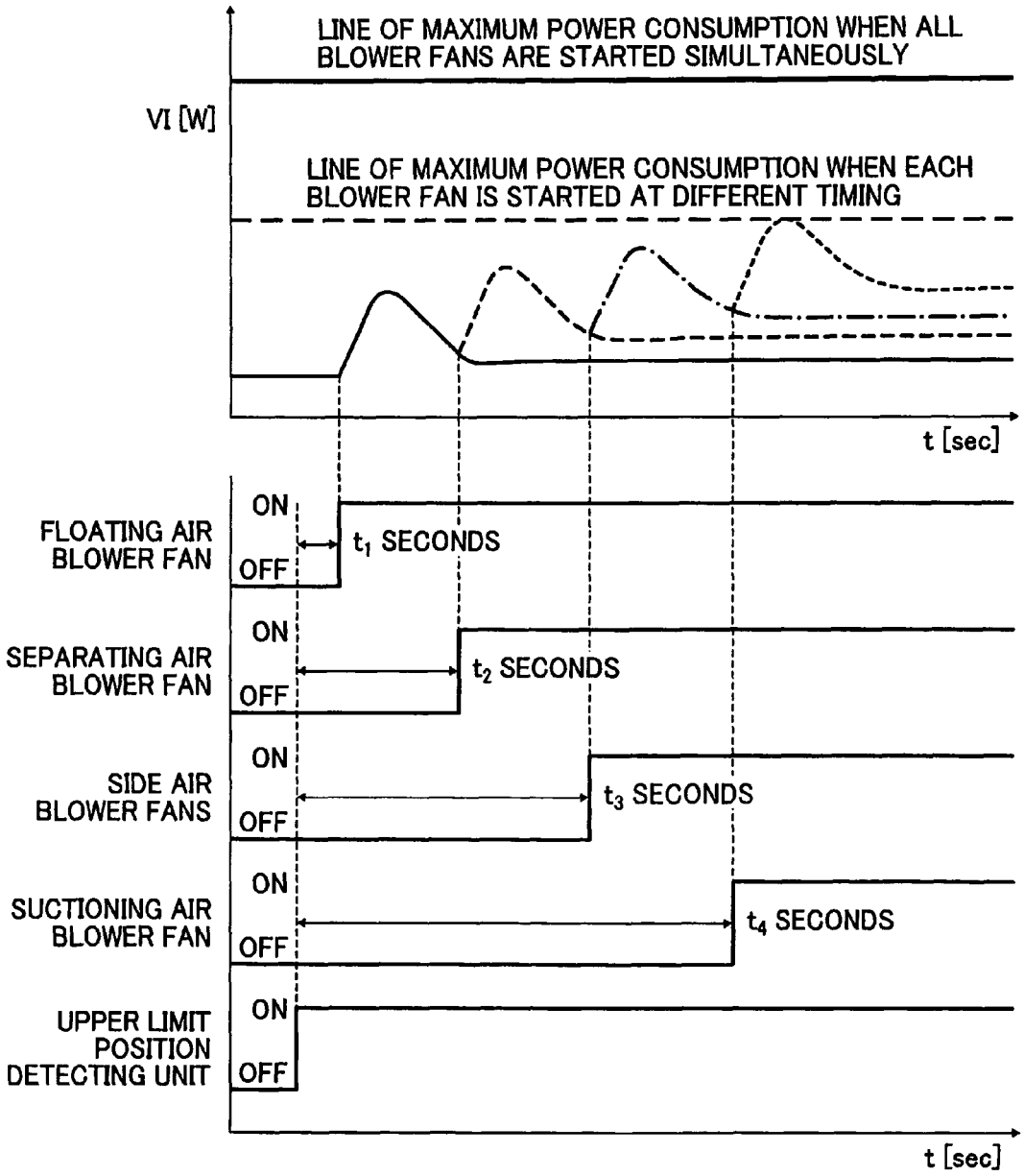
FIG. 7 shows a relationship between operational timings at which blower fans included in the sheet feeding device according to the embodiment are driven and power consumption.

Furthermore, as illustrated in FIG. 7, the feeding controlling section 101 controls to start driving the floating air blower fan 22, the separating air blower fan 23, the side air blower fans 24, and the suctioning air blower fan 25 all at different operational timings. Therefore, the operational timings at which power consumption surges immediately after starting driving the blower fans differ from each other. Therefore, in the sheet feeding device 10 according to the embodiment in which the blower fans are started to be driven at different operational timings, the line of the maximum power consumption in driving the blower fans is lower than the line of the conventional maximum power consumption when all of the blower fans are started to be driven at the same time.

Figure 8:
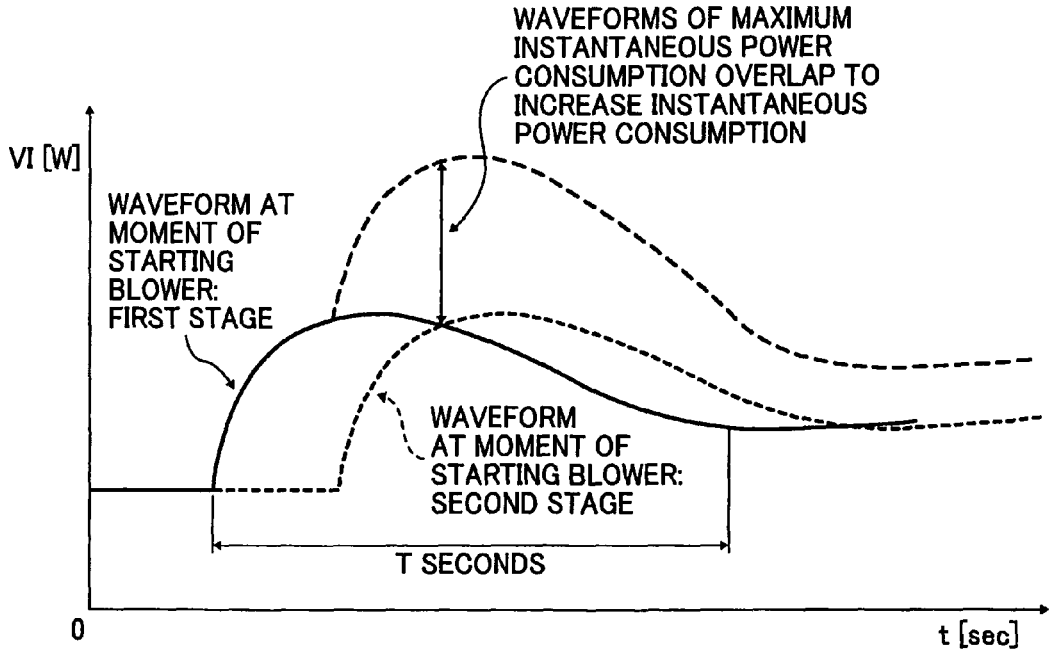
FIG. 8 is a graph of power consumption overlapping at the time when blower fans are started.

An explanation of how the operational timings $t_1$ to $t_4$ seconds for starting driving the blower fans illustrated in FIG. 7 are set will be provided below with reference to FIGS. 8 and 9.

As mentioned earlier, the feeding controlling section 101 starts driving each of the blower fans after different specified seconds ($t_1$ to $t_4$ seconds) elapses. If the time interval between $t_1$ seconds and $t_2$ seconds, for example, is too short, the waveform (a first stage) of the power consumption upon starting (starting driving) the floating air blower fan 22 might overlap with the waveform (a second stage) of the power consumption upon starting (starting driving) the separating air blower fan 23, as illustrated in FIG. 8. As a result, the instantaneous maximum power consumption could be increased.

Therefore, in the embodiment, as for the example of the operational timing for starting driving the floating air blower fan 22 and the operational timing for starting driving the separating air blower fan 23, it is preferable that, after the feeding controlling section 101 starts driving the floating air blower fan 22, the feeding controlling section 101 starts driving the separating air blower fan 23 after the power consumption surging at the moment of starting driving the floating air blower fan 22 lowers sufficiently and stabilizes. In this manner, it is possible to cause the power consumption waveform surging at the moment of starting driving the floating air blower fan 22 not to overlap with the power consumption waveform surging at the moment of starting driving the separating air blower fan 23. The same can be said for the relationship between the separating air blower fan 23 and the side air blower fans 24, and the relationship between the side air blower fans 24 and the suctioning air blower fan 25.

Figure 9:
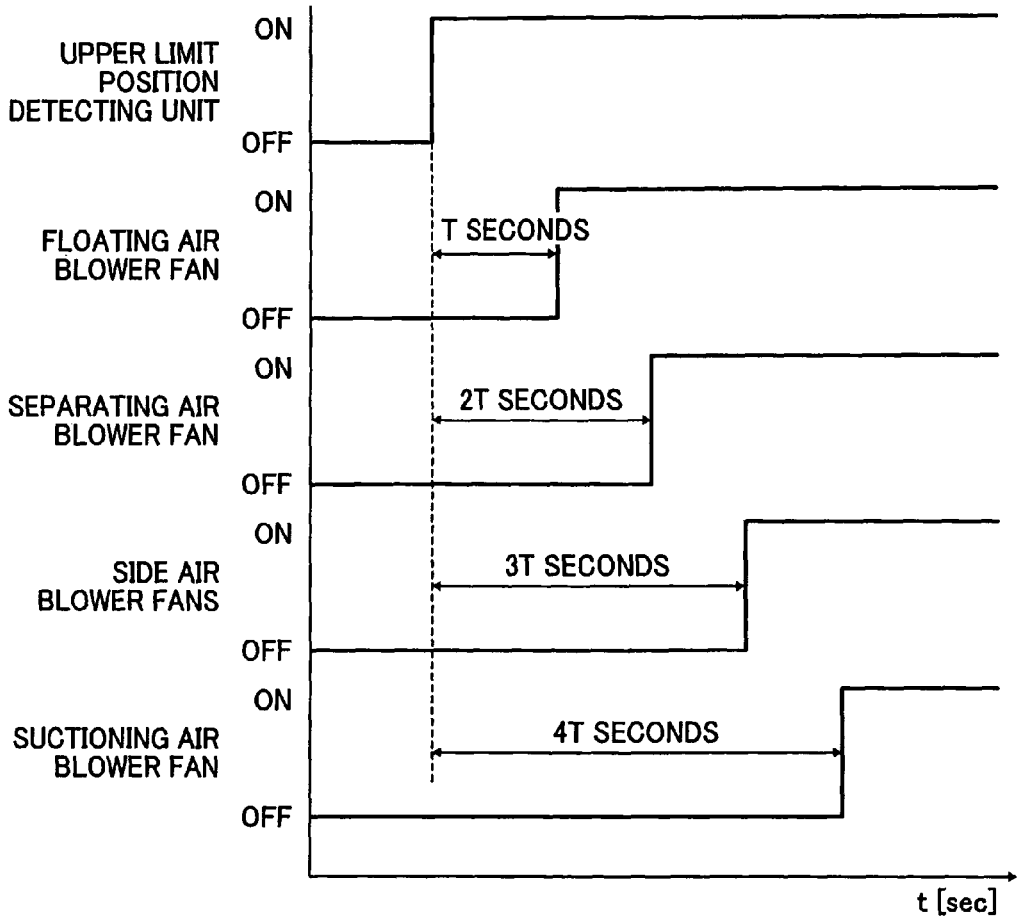
FIG. 9 is a timing chart of an operational timing at which each of the blower fans included in the sheet feeding device according to the embodiment is started to be driven.

Therefore, in the embodiment, when a time until the power consumption surging at the moment of starting driving each of the blower fans sufficiently lowers and stabilizes is defined as T seconds, the operational timings are set so that each of the floating air blower fan 22, the separating air blower fan 23, the side air blower fans 24, and the suctioning air blower fan 25 is started to be driven sequentially at a time interval of an integral multiple of T seconds after the upper limit position detecting unit 17 detects that the sheet is at the upper limit detecting position, as illustrated in FIG. 9.

In other words, the feeding controlling section 101 starts driving the floating air blower fan 22 in T seconds (one multiple of T seconds), starts driving the separating air blower fan 23 in 2T seconds (double T seconds), starts driving the side air blower fans 24 in 3T seconds (triple T seconds), and starts driving the suctioning air blower fan 25 in 4T seconds (quadruple T seconds) after the sheet is detected to be at the upper limit detecting position. T seconds according to the embodiment corresponds to a certain time unit according to the present invention.

In this manner, in the embodiment, it is preferable for $t_1$ to $t_4$ seconds to be set to T seconds to 4T seconds, respectively.

An operational timing at which each of the blower fans is stopped being driven when the paper feeding job is completed will now be explained with reference to FIG. 10.

Figure 10:
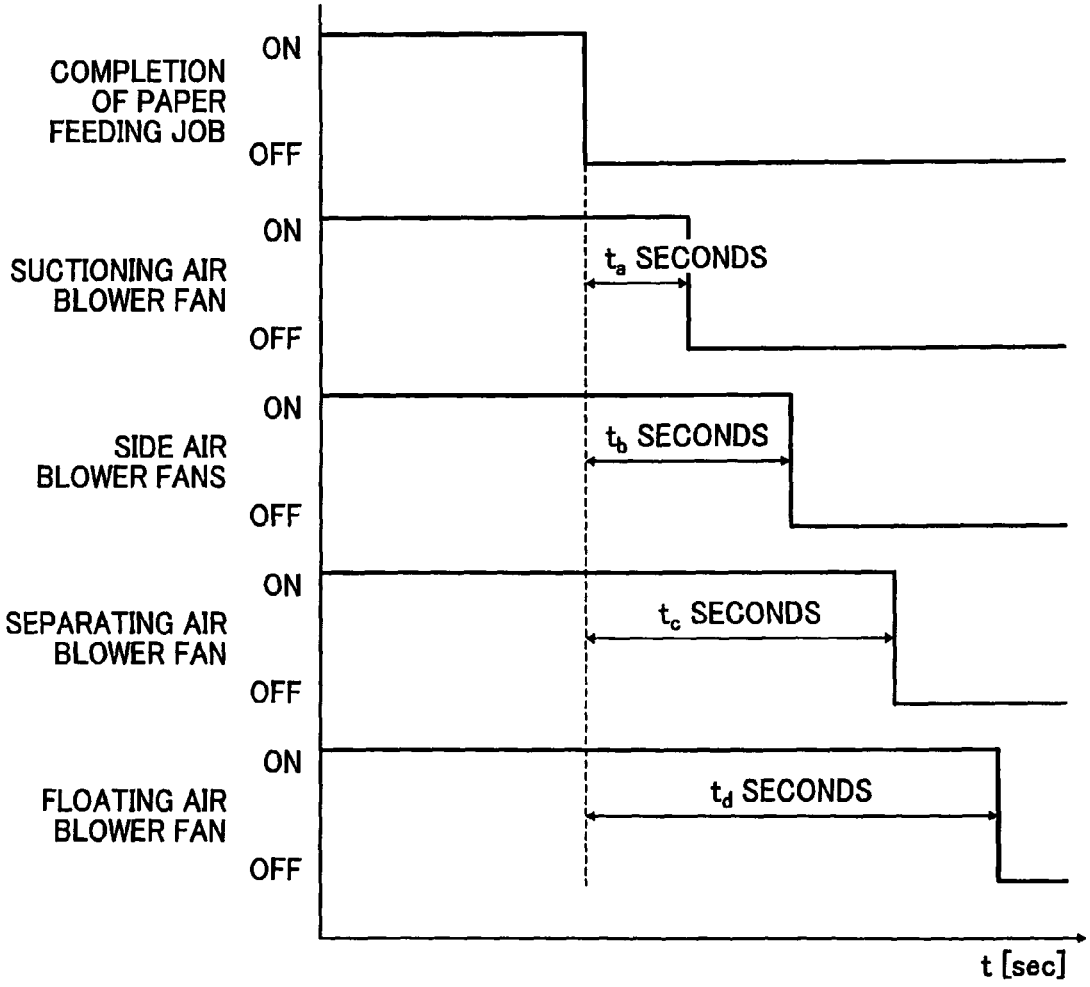
FIG. 10 is a timing chart of an operational timing at which each of the blower fans included in the sheet feeding device according to the embodiment is stopped being driven.
Figure 11:
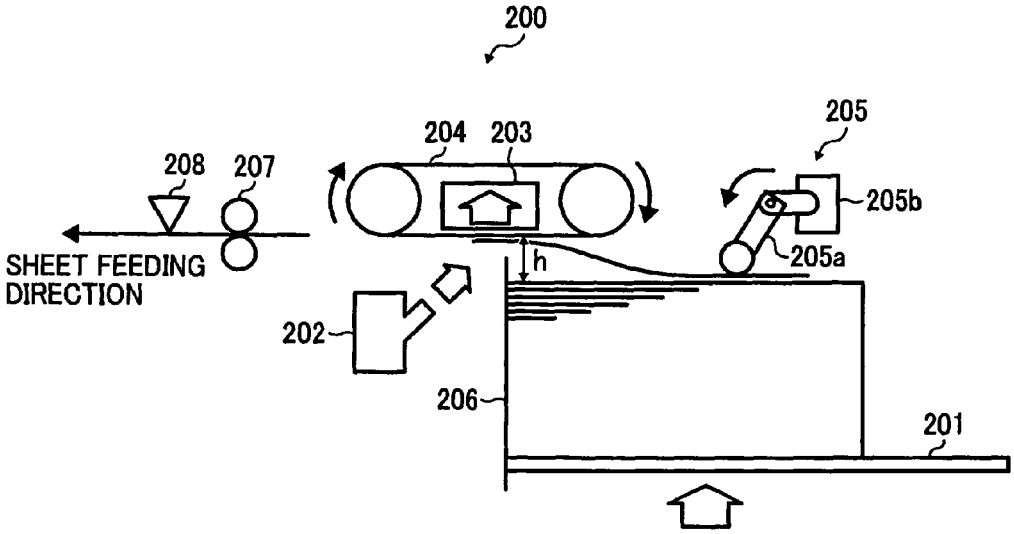
FIG. 11 CONVENTIONAL ART
FIG. 11 is a schematic of an overall structure of a conventional sheet feeding device.
Figure 12A:
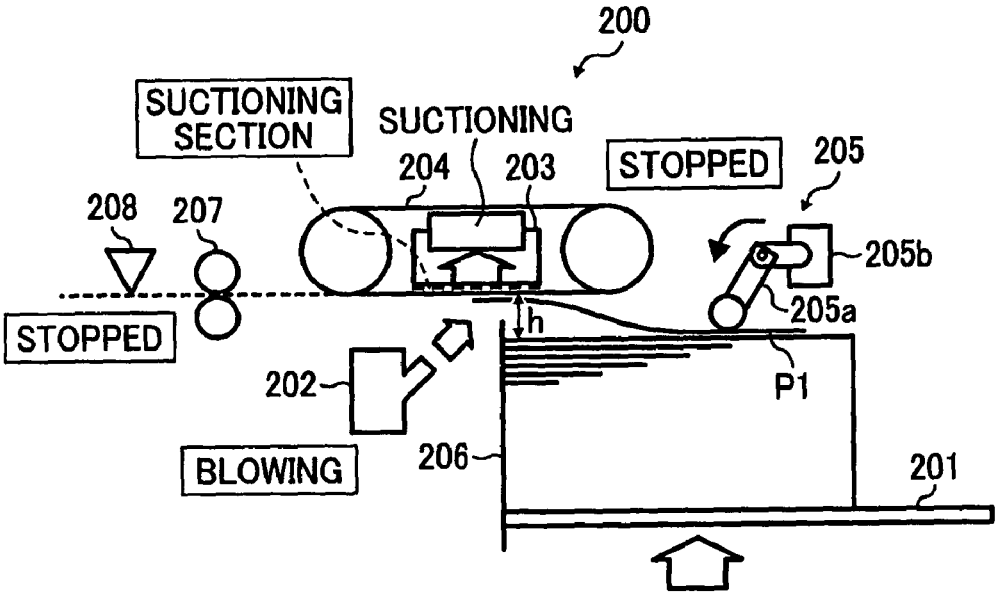
FIG. 12A CONVENTIONAL ART
FIG. 12A illustrates an operation of the conventional sheet feeding device separating and suctioning a sheet.
Figure 12B:
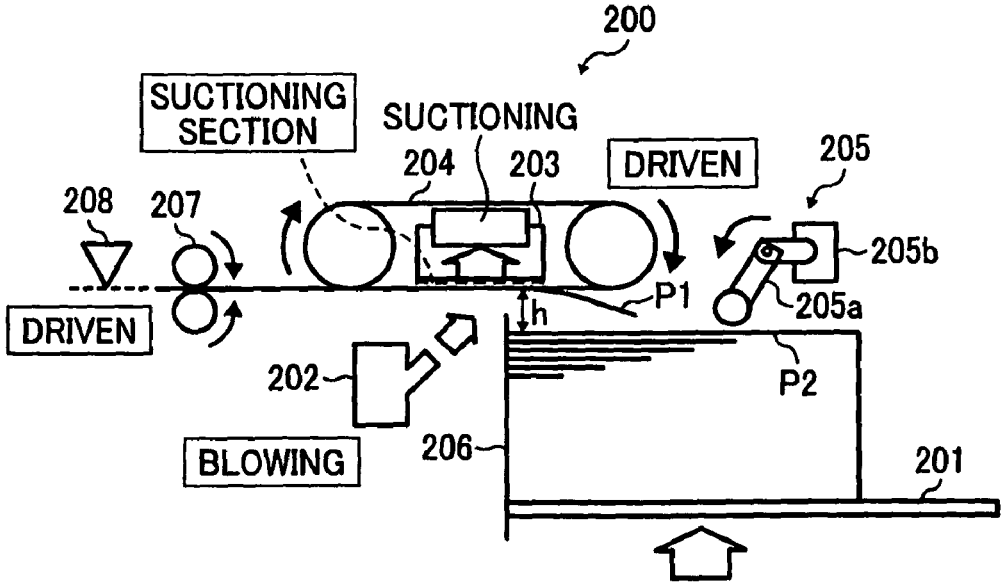
FIG. 12B CONVENTIONAL ART
FIG. 12B illustrates an operation of the conventional sheet feeding device feeding the sheet.
Figure 12C:
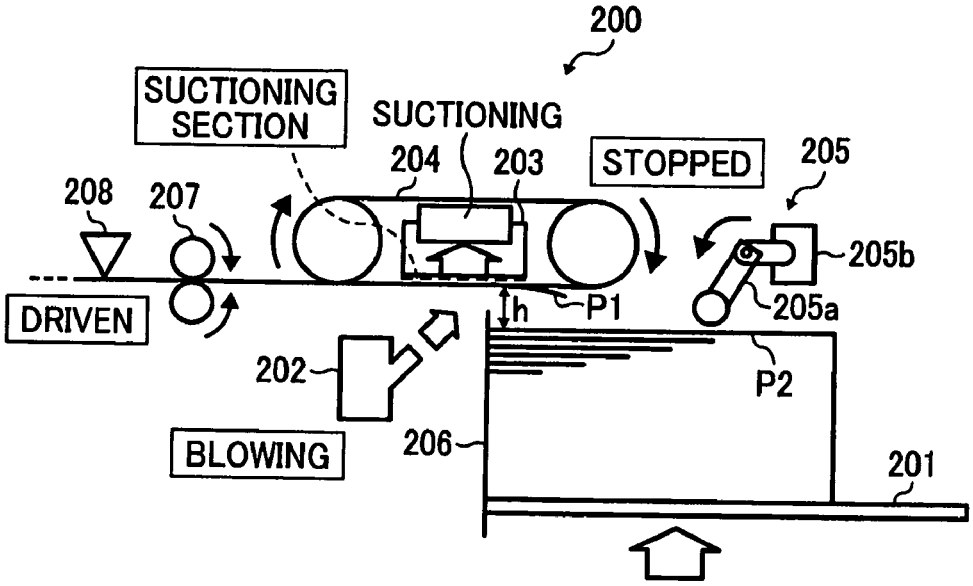
FIG. 12C CONVENTIONAL ART
FIG. 12C illustrates an operation of the conventional sheet feeding device conveying the sheet.
Figure 12D:
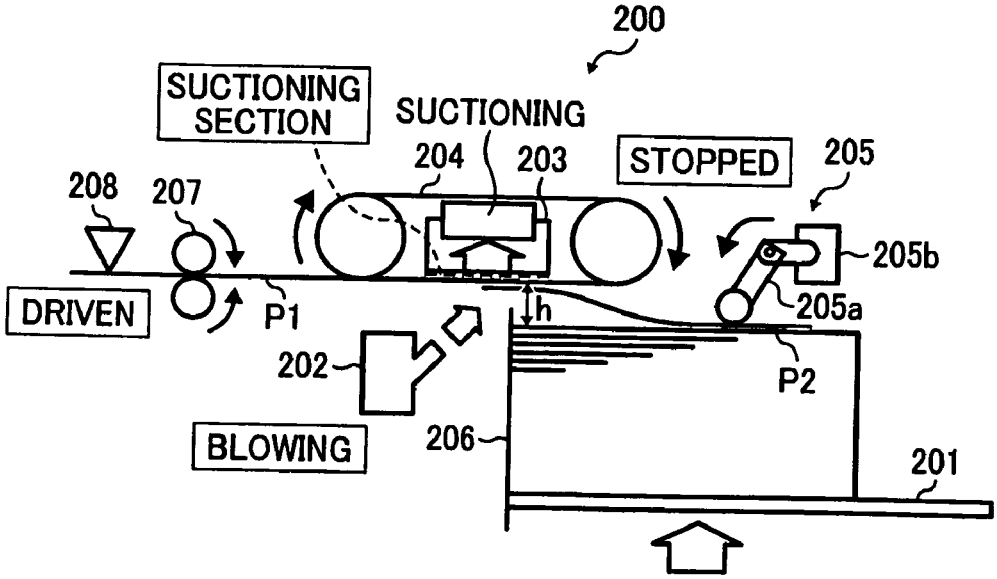
FIG. 12D CONVENTIONAL ART
FIG. 12D illustrates an operation of the conventional sheet feeding device separating and suctioning a next sheet.

As illustrated in FIG. 10, in the embodiment, the feeding controlling section 101 controls to stop driving the suctioning air blower fan 25 in $t_a$ seconds, to stop driving the side air blower fans 24 in $t_b$ seconds, to stop driving the separating air blower fan 23 in $t_c$ seconds, and to stop driving the floating air blower fan 22 in $t_d$ seconds after the paper feeding job is completed. In other words, when a paper feeding job is completed, the operation of each of the devices is stopped in the order of suctioning of the air by the air suctioning device 15, blowing of the air by the side air blowing devices 14, blowing of the air by the separating air blowing device 13, and blowing of the air by the floating air blowing device 12.

In this manner, an allowance of a certain time ($t_d$-$t_a$) is ensured between the operational timing of stopping driving the suctioning air blower fan 25 and the operational timing of stopping driving the floating air blower fan 22. In the embodiment, it is preferable for $t_a$ seconds to $t_d$ seconds to be set to appropriate values such that the certain time ($t_d$-$t_a$) corresponds to a time needed until movement of the suctioning air blower fan 25 by the inertia is stopped (or sufficiently weakened).

As described above, in the embodiment, the feeding controlling section 101 controls to cause the floating air blowing device 12 to blow the air, to cause the separating air blowing device 13 to blow the air, to cause the side air blowing devices 14 to blow the air, and to cause the air suctioning device 15 to suction the air all at different operational timings in the separating and suctioning operation. Therefore, the operational timings of the surging power consumption resulting from the blowing of the air and the suctioning of the air can be differentiated.

Therefore, an enormous amount of power consumed in performing all of the air blowing operations and the air suctioning operation at the same time in conventional examples can be reduced or suppressed.

Furthermore, in the embodiment, the feeding controlling section 101 controls to perform the separating and suctioning operation in the order of blowing of the air performed by the floating air blowing device 12, blowing of the air performed by the separating air blowing device 13, blowing of the air performed by the side air blowing devices 14, and suctioning of the air performed by the air suctioning device 15. Therefore, the positioning of the floated sheet can be stabilized. Because the sheet can be fed in a stabilized position, a skew or a registration error can be prevented.

Furthermore, in the embodiment, after the upper limit position detecting unit 17 detects the paper feed tray 11, the feeding controlling section 101 performs the separating and suctioning operation in the order of blowing of the air performed by the floating air blowing device 12, blowing of the air performed by the separating air blowing device 13, blowing of the air performed by the side air blowing devices 14, and suctioning of the air performed by the air suctioning device 15 at time intervals (T seconds to 4T seconds) of integral multiples of a certain time unit T seconds. As a result, it is possible to prevent the next blowing or suctioning of the air from being performed before the power consumption, which surges at the moment of starting the operations of the blower fans in the air blowing devices, drops and stabilizes. Because the time of surging power consumption at the moment of blowing and suctioning of the air does not overlap in any part, the power consumption can be further reduced.

Furthermore, in the embodiment, when a paper feeding job is completed, the feeding controlling section 101 controls to end the separating and suctioning operation in the order of suctioning of the air performed by the air suctioning device 15, blowing of the air performed by the side air blowing devices 14, blowing of the air performed by the separating air blowing device 13, and blowing of the air performed by the floating air blowing device 12. Therefore, a time allowance is ensured between the time when the air suctioning device 15 stops suctioning the air and the time when the floating air blowing device 12 stops blowing the air, thereby reducing the movement of the suctioning air blower fan 25 due to inertia thereof during this time.

Therefore, sheets can be prevented from being suctioned to and retained by the suctioning belt 16 after the paper feeding operation is completed. As a result, it is possible to prevent the sheets from falling into a position in the sheet feeding device body where the user would have a difficult time removing them, or from being damaged due to such causes.

In the embodiment, the floating air blower fan 22 is started to be driven when $t_1$ seconds or T seconds have elapsed since the upper limit position detecting unit 17 detected the paper feed tray 11. However, the present invention is not limited thereto, and the floating air blower fan 22 may be started to be driven at the same time as the upper limit position detecting unit 17 detects the paper feed tray 11, for example. Furthermore, as to the operational timing for starting driving the floating air blower fan 22 illustrated in FIG. 9, the floating air blower fan 22 may be started to be driven when a certain time shorter than T seconds has elapsed without waiting for T seconds to elapse. In such a case, it is preferable for the separating air blower fan 23 to be started to be driven when the certain time plus T seconds have elapsed, for the side air blower fans 24 to be started to be driven when the certain time plus 2T seconds have elapsed, and for the suctioning air blower fan 25 to be started to be driven when the certain time plus 3T seconds have elapsed.

According to the present embodiment, it is possible to provide a sheet feeding device and an image forming apparatus being capable of reducing power consumption and, stabilizing the position of sheets during a separating and feeding operation, and allowing the sheets to be removed without any problem after the paper feeding operation is completed.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A sheet feeding device, comprising:

an air separating unit that blows air to a stacked bundle of sheets to separate each of sheets in the bundle;

an air suctioning unit that suctions air to suction a top sheet having been separated from the stacked bundle of sheets; and a sheet feeding unit that feeds the sheet, which is suctioned to and retained by the air suctioning unit in a separating and suctioning operation performed by the air separating unit and the air suctioning unit, in a sheet feeding direction, wherein the air separating unit includes:

a floating air blowing unit that blows air to leading edges of the bundle of sheets in the sheet feeding direction to float upper sheets including at least the top sheet in the bundle;

a separating air blowing unit that blows air to the leading edges of the bundle of sheets in the sheet feeding direction, which are floated by the floating air blowing unit, to separate each sheet in the bundle; and side air blowing units that blow air to both side edges of the bundle of sheets to separate each of the sheets in the bundle, which are floated, from both side edges of the bundle of sheets; and wherein the sheet feeding device further includes a control unit that controls to cause the floating air blowing unit to blow the air, to cause the separating air blowing unit to blow the air, to cause the side air blowing units to blow the air, and to cause the air suctioning unit to suction the air all at different operational timings and in an exact order of operational timings in the separating and suctioning operation.

2. The sheet feeding device according to claim 1, wherein the control unit controls to perform the separating and suctioning operation in an exact order of blowing of the air performed by the floating air blowing unit, blowing of the air performed by the separating air blowing unit, blowing of the air performed by the side air blowing units, and suctioning of the air performed by the air suctioning unit.

3. The sheet feeding device according to claim 2, further comprising:

a paper feed tray on which the bundle of sheets is stacked, and that is movable up and down in a vertical direction; and an upper limit position detecting unit that detects the top sheets reaching a specified position as the paper feed tray is moved up, wherein the control unit performs the separating and suctioning operation in an exact order of blowing of the air performed by the floating air blowing unit, blowing of the air performed by the separating air blowing unit, blowing of the air performed by the side air blowing units, and suctioning of the air performed by the air suctioning unit at time intervals of integral multiples of a certain time unit after the upper limit position detecting unit detects the paper feed tray, and the certain time unit corresponds to an operational timing at which power consumption surges immediately after starting of each of the floating air blowing unit, the separating air blowing unit, the side air blowing units, and the air suctioning unit, to drop and stabilize.

4. The sheet feeding device according to claim 2, wherein when the floating air blowing unit, the separating air blowing unit, and the side air blowing units are started to be driven at different operational timings, a maximum power consumption in driving the air blowing unit, the separating air blowing unit, and the side air blowing units is lower than a maximum power consumption when all of the floating air blowing unit, the separating air blowing unit, and the side air blowing units are started to be driven at the same time.

5. The sheet feeding device according to claim 2, wherein the operational timing for starting driving the floating air blower unit is started to be driven when a certain time shorter than T seconds has elapsed without waiting for T seconds to elapse, for the separating air blower unit to be started to be driven when the certain time plus T seconds have elapsed, for the side air blower units to be started to be driven when the certain time plus $T_2$ seconds have elapsed, and for the air suctioning unit to be started to be driven when the certain time plus $T_3$ seconds have elapsed.

6. The sheet feeding device according to claim 2, wherein control unit controls to start driving the floating air blower unit in $T_1$ seconds, to start driving the separating air blower unit in $T_2$ seconds, to start driving the side air blower units in $T_3$ seconds, and to start driving the suctioning air blower unit $T_4$ seconds after the sheet is detected to be at the upper limit detecting position.

7. The sheet feeding device according to claim 2, wherein control unit controls to stop driving the suctioning air blower unit in $T_1$ seconds, to stop driving the side air blower units in $T_2$ seconds, to stop driving the separating air blower unit in $T_3$ seconds, and to stop driving the floating air blower unit in $T_4$ seconds after the paper feeding job is completed.

8. The sheet feeding device according to claim 1, wherein the air suctioning unit includes a suctioning air blower fan as a driving source of suctioning air, and the control unit controls to end the separating and suctioning operation in the order of suctioning of the air performed by the air suctioning unit, blowing of the air performed by the side air blowing units, blowing of the air performed by the separating air blowing unit, and blowing of the air performed by the floating air blowing unit.

9. The sheet feeding device according to claim 1, wherein the air suctioning unit is disposed above the floating air blowing unit and the separating air blowing unit.

10. The sheet feeding device according to claim 1, wherein the air suctioning unit includes a suctioning chamber housed in a space surrounded by a suctioning belt located above and below the space, and a suctioning duct connecting the air suctioning unit to the suctioning chamber.

11. The sheet feeding device according to claim 10, wherein the suctioning belt has a plurality of holes for allowing the air to be suctioned.

12. The sheet feeding device according to claim 10, wherein the suctioning belt is stretched across a driven roller and a driving roller, and moves endlessly by the rotation of the driving roller.

13. An image forming apparatus comprising:

a sheet feeding device; and an image forming unit that forms an image on a sheet separated and fed by the sheet feeding device, wherein the sheet feeding device includes:

an air separating unit that blows air to a stacked bundle of sheets to separate each of sheets in the bundle;

an air suctioning unit that suctions air to suction a top sheet having been separated from the stacked bundle of sheets; and a sheet feeding unit that feeds the sheet, which is suctioned to and retained by the air suctioning unit in a separating and suctioning operation performed by the air separating unit and the air suctioning unit, in a sheet feeding direction, wherein the air separating unit includes:

a floating air blowing unit that blows air to leading edges of the bundle of sheets in the sheet feeding direction to float upper sheets including at least the top sheet in the bundle;

a separating air blowing unit that blows air to the leading edges of the bundle of sheets in the sheet feeding direction, which are floated by the floating air blowing unit, to separate each sheet in the bundle; and side air blowing units that blow air to both side edges of the bundle of sheets to separate each of the sheets in the bundle, which are floated, from both side edges of the bundle of sheets; and wherein the sheet feeding device further includes a control unit that controls to cause the floating air blowing unit to blow the air, to cause the separating air blowing unit to blow the air, to cause the side air blowing units to blow the air, and to cause the air suctioning unit to suction the air all at different operational timings and in an exact order of operational timings in the separating and suctioning operation.

* * * * *